United States Patent [19]

Akkerman

[11] Patent Number: 4,591,197

[45] Date of Patent: May 27, 1986

[54] WIRE LINE RUNNING AND/OR PULLING TOOL

[75] Inventor: Neil H. Akkerman, Houston, Tex.

[73] Assignee: AVA International Corp., Houston, Tex.

[21] Appl. No.: 700,798

[22] Filed: Feb. 11, 1985

Related U.S. Application Data

[63] Continuation-in-part of Ser. No. 536,276, Sep. 27, 1983, abandoned.

[51] Int. Cl.[4] ..... E21B 31/10

[52] U.S. Cl. ..... 294/86.24; 294/86.17; 294/86.33

[58] Field of Search ..... 294/86.24, 86.33, 86.17, 294/86.1, 86.11, 86.12, 86.14, 86.25, 86.26, 86.28, 86.29, 86.32, 86.34; 166/99, 101, 170, 173, 174, 241

[56] References Cited

U.S. PATENT DOCUMENTS 1,775,291 9/1930 Niles ..... 294/96.24
3,128,828 4/1964 Skinner ..... 294/86.24
3,895,837 7/1975 Barnes ..... 294/86.24

*Primary Examiner*—James B. Marbert
*Attorney, Agent, or Firm*—Vaden, Eickenroht Thompson & Jamison

[57] ABSTRACT

These are disclosed three embodiments of a wire line tool for use in running and/or pulling a well tool within a well bore. In each embodiment, latches are carried about a body of the wire line tool and yieldably urged from inner positions, in which their outer ends are adapted to move into the well tool, to outer positions in which their outer ends extend into a groove in the well tool when opposite thereto. The wire line tool may be latched to the well tool at the surface for the purpose of running it into the well tool, or lowered into a well bore and latched to a well tool therein for the purpose of pulling the well tool. The latches are forced inwardly to remove their outer ends from the groove, and then retained against outward movement, in response to downward jarring of the body and subsequent lifting of the body with the wire line to permit the wire line tool to be retrieved from the well tool following running of the well tool into the well bore.

12 Claims, 14 Drawing Figures

Fig. 12
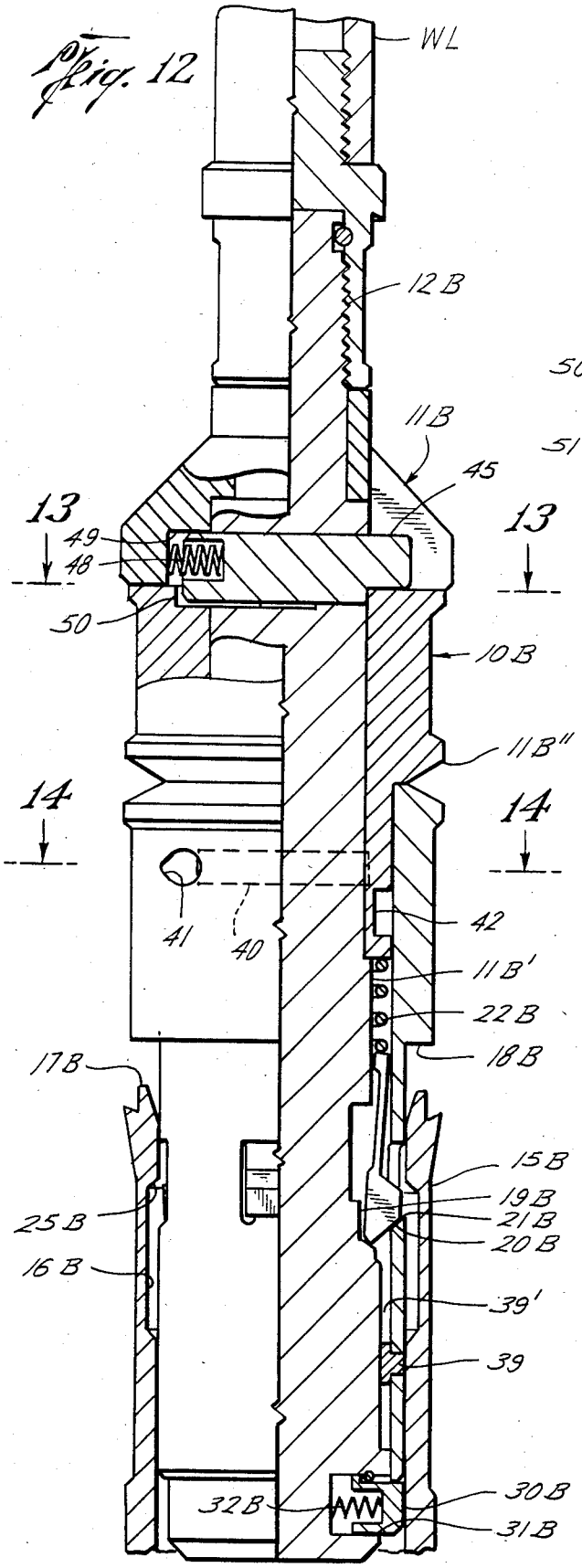
Fig. 13
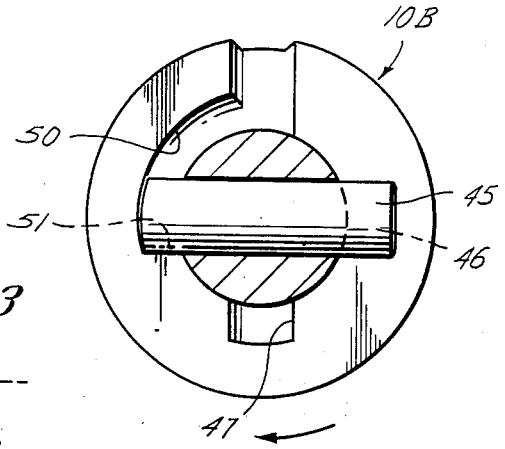
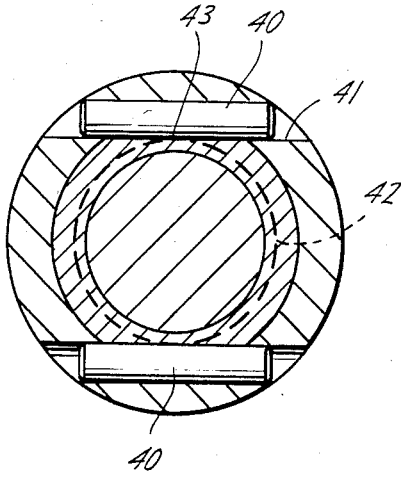
Fig. 14

WIRE LINE RUNNING AND/OR PULLING TOOL

This application is a continuation in part of my copending application, Ser. No. 536,276, filed Sept. 27, 1983, and entitled, "Wire Line Running Tool and/or Pulling Tool", now abandoned.

This invention relates to a tool of the type which is adapted to be latched within a groove of a well tool and which may be manipulated by a wire line for the purpose of running the well tool into and/or pulling the well tool from a well conduit. More particularly, it relates to improvements in a wire line tool of this type having latches which are spring pressed from inner positions, in which they be moved into the open end of the well tool and opposite a groove about the inner diameter of the well tool, to outer positions, in which they are held within the groove, and wherein the wire line may be manipulated to release the latches in order to permit retrieval of the wire line tool from the well tool following running of the well tool into the well bore.

One tool of this type, which is known as the Otis type GS running/pulling tool, has a body adapted to be raised and lowered on a wire line and latching dogs which are carried about the body for vertical movement between upper positions in which lugs on the lower ends of the dogs may be moved through one end of the well tool into and out of positions opposite a groove therein, and lower positions in which the lugs are forced into and held within the groove. The dogs are urged downwardly toward their lower positons by means of a spring pressed between the dogs and a sleeve which is connected by one or more shear pins to the body, and have conical surfaces which are slidable over complimentary surfaces on the body to move the lugs outwardly into the groove, and cylindrical surfaces which are slidable over a complimentary surface on the body to hold the lugs in the groove. When the wire line tool is to be retrieved after running the well tool into the well bore, the body is jarred upwardly to shear the pins and move the cylindrical surface on the body out of holding position. The body is then held downwardly by another spring acting between it and the sleeve so that the dogs will be forced inwardly to permit the wire line tool to be withdrawn from the well tool as it is raised with the wire line. Alternatively, when the wire line tool is used to pull a well tool from the wellbore, the spring is compressed as the lugs on the latching dogs are lowered with the body into engagement with the seat about the open end of the well tool, so that the lugs will move into and through the open upper end of the well tool into latching positions within the groove in the well tool.

One problem with the tool of the type above described is wear on its parts due to slack or freedom of vertical movement between the lugs and the groove in the well tool when latched. Also, in using a wire line tool of this type, it may be necessary, following pulling of the well tool, to manually compress the spring in order to release the lugs of the latching dogs from the groove in the well tool. Due to the strength of this spring, this can be a difficult and in any event a dangerous procedure. Thus, the operator may instead elect to either remove or shear the pins which connect the sleeve to the body of the pulling tool. However, these pins are both difficult to remove and replace in order to prepare the wire line tool for use in running a well tool into the well bore.

One object of this invention is to provide a wire line tool of this type in which their need be essentially no slack between the latches and the upper end of the groove in the well tool against which the outer ends of the latches are adapted to bear, but in which the configuration of the groove and thus the well tool may nevertheless be the same as that which is adapted to receive the latching dogs of the aforementioned prior wire line tool, or latches of similar wire line tools.

Another object of this invention is to provide a wire line tool of this type which is easily and quickly unlatched from the well tool, upon pulling the well tool, without the need for manually compressing a strong spring or removing or shearing shear pins.

These and other objects are accomplished, in accordance with one aspect of the invention, and as illustrated by certain its embodiments, by a tool of this type having a body adapted to be raised and lowered on a wire line and latches carried by the body for sliding along guide surfaces on the body which extend downwardly and outwardly with respect to the axis of the body, means on the body cooperable with a seat on the well tool for locating the outer ends of the latches opposite the groove in the well tool, and means yieldably urging the latches from inner positions, in which their outer ends are adapted to move through the open end of the well tool into and out of positions opposite the groove, to outer positions in which their outer ends extend into the groove. More particularly, the upper sides of the latches have bearing surfaces which are engagable with the upper end of the groove, when the outer ends of the latches extend into the groove, to support the well tool from the wire line, and are so related to bearing surfaces on the lower sides of the latches engagable with the guide surfaces on the body, when the well tool is so supported, as to prevent inward movement of the latches, and the wire line tool also includes means which is responsive to vertical movement of the body with respect to the well tool for forcing the latches inwardly to retract their outer ends from the groove and retain them in their retracted positions, so that the wire line tool may be retrieved from the well tool.

As illustrated, the means for moving the latches inwardly and retaining them in retracted positions comprises a sleeve which is disposed about and mounted on the body to dispose cam surfaces thereon adjacent the outer ends of the latches, and which has a shoulder thereon which is landable on the seat to locate the outer ends of the latches opposite the groove in the well tool. Upon release of the sleeve from the body, and vertical movement of the body in one direction with respect to the sleeve, the outer ends of the latches are forced inwardly and out of the groove by the cam surfaces and held within the sleeve, and means are provided for limiting movement of the body in the opposite vertical direction so that the latches are retained by the sleeve to permit the wire line tool to be retrieved from the well conduit.

The sleeve is mounted on the body of the running tool by a pin which is sheared in response to downward jarring of the body and which, in accordance with another novel aspect of the present invention, and as illustrated in certain embodiments of the invention, extends through the sleeve and into a groove formed about a portion of the body. More particularly, the groove is of arcuate shape to permit relative rotation between the sleeve and body portion, the sleeve has cam means which is operable, upon such rotation, for forcing the latches inwardly and holding them in inner positions without shearing the pin, and the sleeve and body portion are held against rotation by detent means which is releasable, following retrieval of the wire line tool and well tool from the well bore, so that the latches may be retracted without the need for manually compressing the spring or without shearing of the pin, and only upon rotation of sleeve and body portion with respect to one another and thus not accidentally as the wire line tool is raised and lowered within a well bore.

In accordance with one embodiment, the latches are carried by said body portion, the last mentioned cam means is in addition to the first mentioned cam means and is adapted to force the latches to their inner positions in response to rotation of said sleeve and body portion with respect to one another, and the detent means is releasably engagable between said body portion and sleeve. In accordance with another embodiment, the latches are carried by another portion of the body which is rotatable with respect to the first mentioned portion, the sleeve is held against rotation with respect to such other portion, the first mentioned body portion has means into which the shear pin may move, upon rotation of the sleeve and first mentioned body with respect to one another, to permit the sleeve to be moved to its upper position and the latches to be forced inwardly by the same cam means which forces them inwardly upon shearing of the pin, and the detent means is releasably engagable between said first mentioned body portion and sleeve.

In the drawings, wherein like reference characters are used through out to designate like parts:

Figure 5:
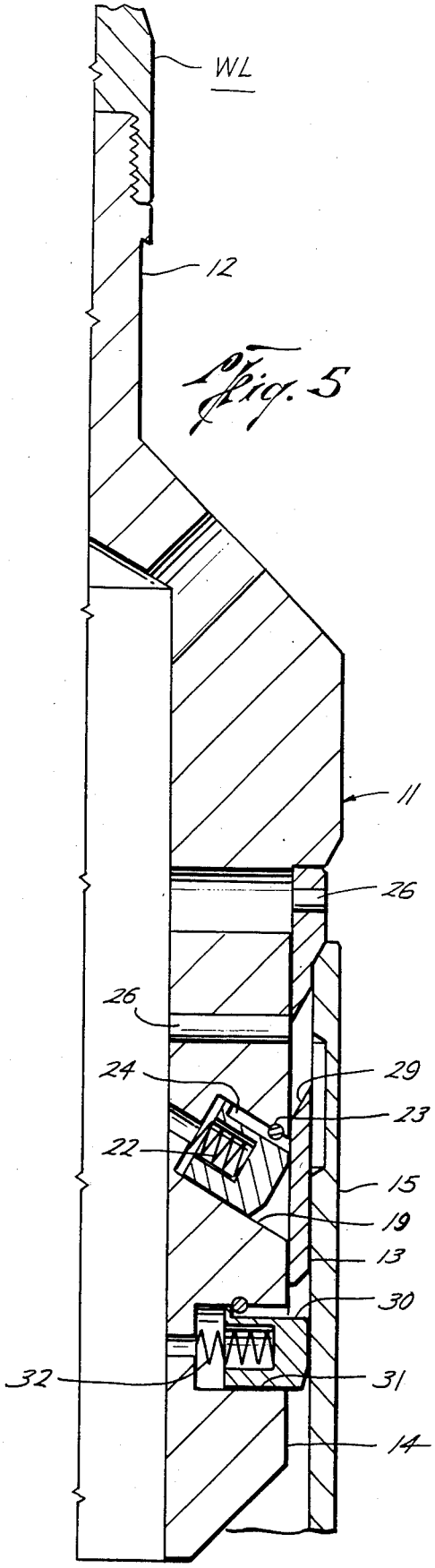
Figure 6:
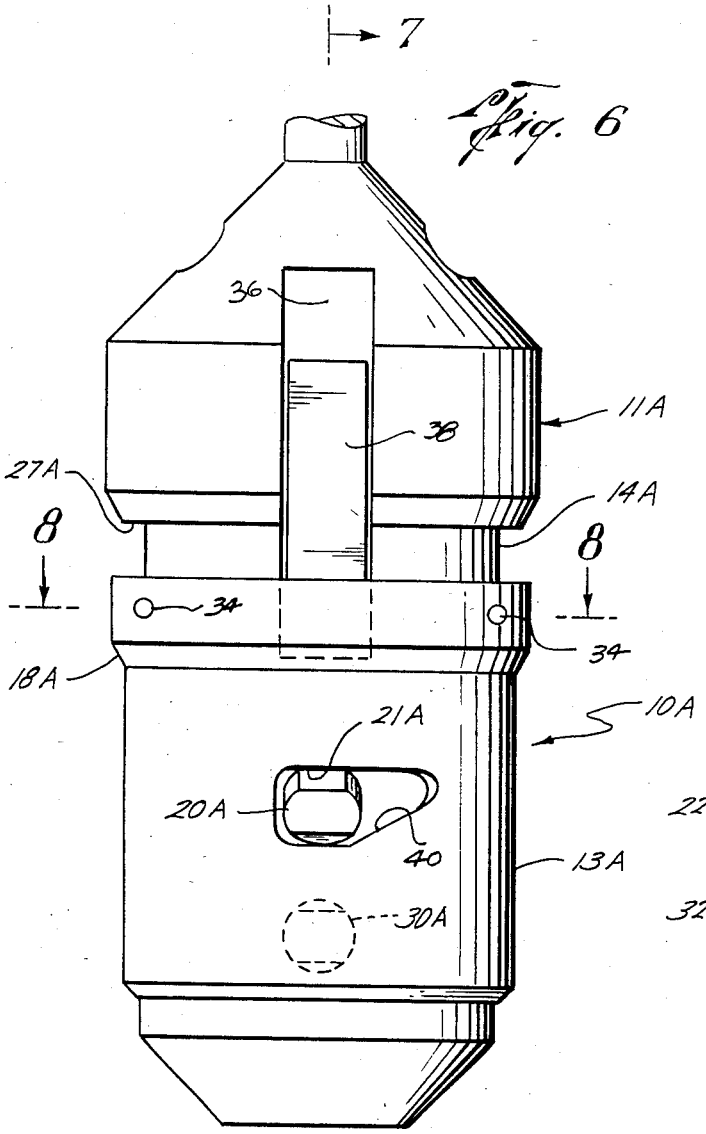
Figure 7:
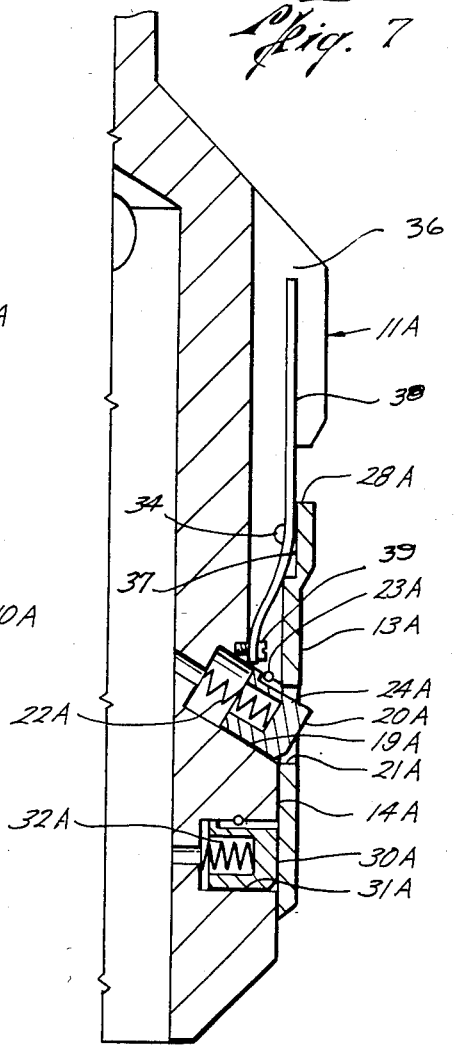
Figure 8:
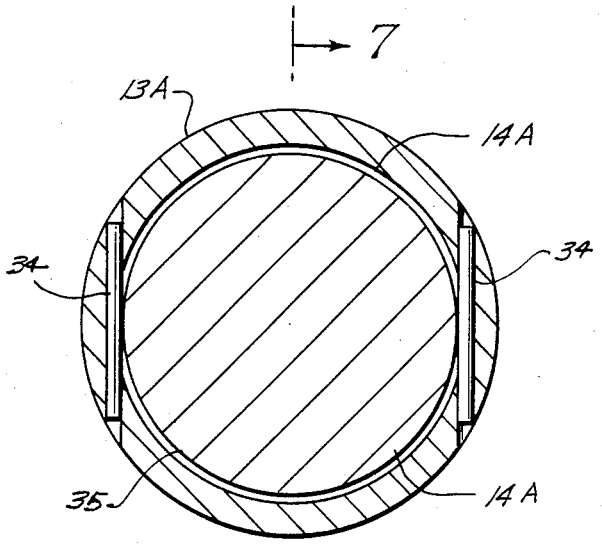
Figure 9:
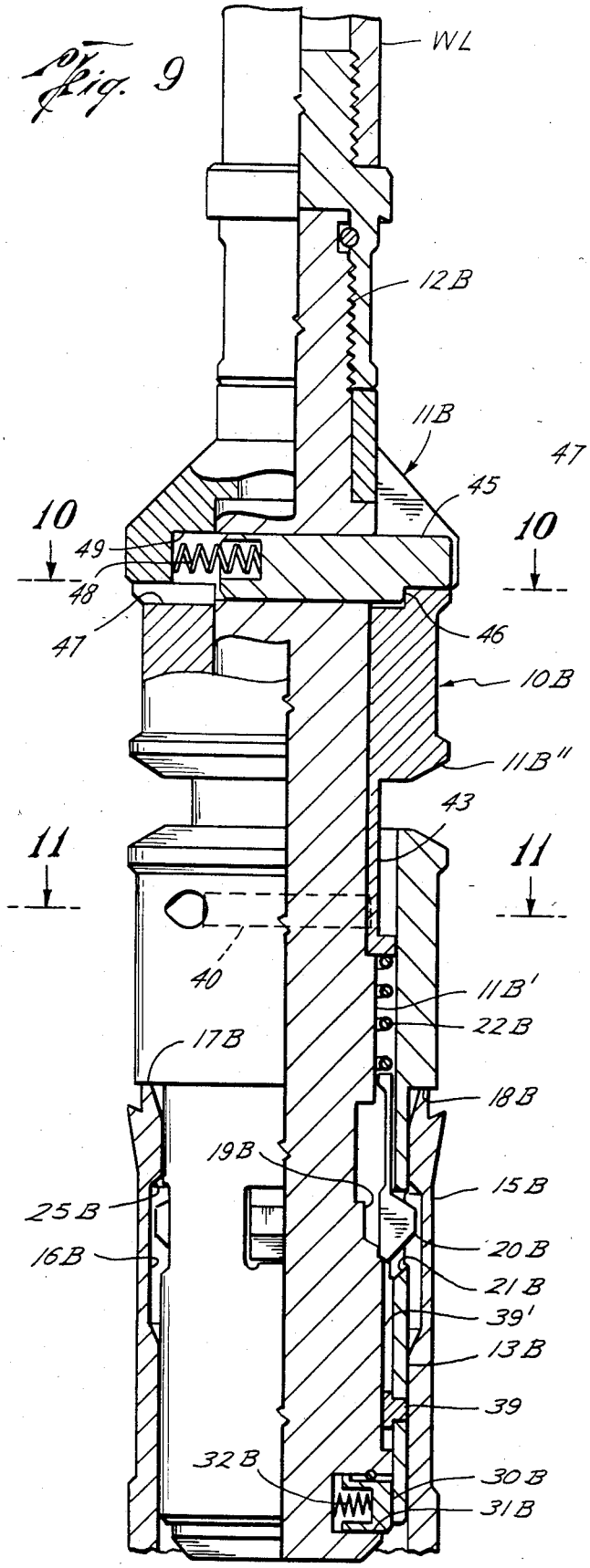
Figure 10:
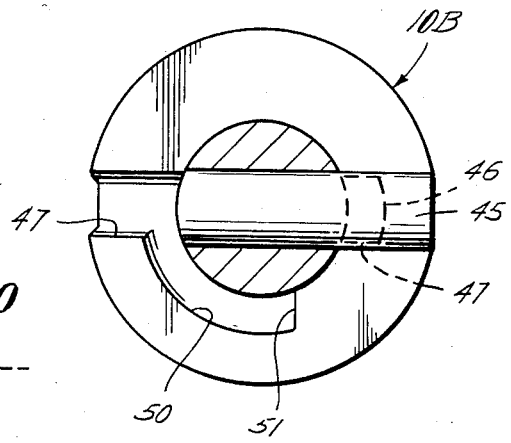
Figure 11:
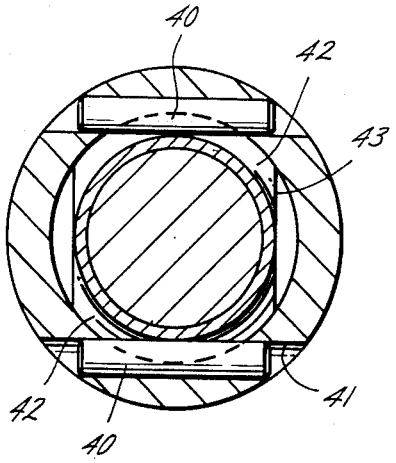

FIG. 5 is a further partial vertical cross-sectional view of the wire line tool and well tool, upon shearing of a pin connecting the body and the sleeve thereabout and lowering of the body with respect to the sleeve so as to force the latches inwardly out of the groove, and upon movement of a pin carried by the body of the running tool outwardly into a position in which its outer end is beneath the sleeve and thus disposed in position to hold the sleeve in its upper position with the body as the body is raised with the wire line to retrieve the wire line tool from the well tool;

FIG. 6 is a vertical sectional view of a well tool constructed in accordance with another embodiment of the present invention, upon removal from the well tool, but with the downwardly and outwardly slidable latches thereof in position for latching within the well tool upon assembly of the wire line tool with the well tool;

FIG. 7 is a vertical sectional view of one-half of the tool of FIG. 6 as seen along broken lines 7—7 thereof;

FIG. 8 is a cross-sectional view of the tool, as seen along broken lines 8—8 of FIG. 6, and showing the connection of the sleeve to the body of the tool by shear pins received within an annular groove about the body;

FIG. 9 is a view, partly in elevation and partly in vertical section, of a wire line tool constructed in accordance with still another embodiment of the present invention, and showing the latching dogs thereof received within a groove in a well tool;

FIG. 10 is a cross-sectional view of the wire line tool, as seen along broken lines 10—10 of FIG. 9, and showing a detent means for releasably holding portions of the body against rotation with respect to one another;

FIG. 11 is another cross-sectional view of the wire line tool, as seen along broken lines 11—11 of FIG. 9, and showing the connection of one such body portion to the sleeve of the tool by means of shear pins extending within arcuate grooves in such one body portion;

FIG. 12 is a view similar to FIG. 9, but upon release of the detent means to permit the body portions to be rotated with respect to one another, and the sleeve raised to an upper position with respect to the body in order to retract the latches from the groove of the well tool without shearing of the pins;

FIG. 13 is a cross sectional view of the wire line tool, as seen along broken lines 13—13 of FIG. 12; and FIG. 14 is a further cross sectional view of the wire line tool, as seen along broken lines 14—14 of FIG. 12.

With reference now to the details of the above-described drawings, the embodiment of the running tool shown in FIGS. 1 to 5, and indicated in its entirety by reference character 10, includes a body 11 having a fishing neck 12 at its upper end for connection to the lower end of a wire line WL, and a sleeve 13 disposed about and releasably mounted on a lower reduced diameter portion 14 of the body. The outer diameter of the sleeve is adapted to fit closely within the inner diameter of a well tool 15 which has a groove 16 thereabout beneath a seat 17 on its upper end. A shoulder 18 is formed on the outer diameter of the sleeve for landing on the seat 17 and thus locating the lower portion 14 of the body longitudinally with respect to the well tool.

A plurality of slots 19 are formed on the body to receive latches 20 for guidably sliding therein along paths which extend downwardly and outwardly with respect to the axis of the body, and the slots are so spaced with respect to the shoulder 18 on the sleeve that the outer ends of the latches are opposite the groove 16 in the well tool when the shoulder is landed on the seat 17. More particularly, latches 20 are adapted to extend through windows 21 formed in the sleeve to permit their outer ends to extend into latching position within well tool groove 16.

Figure 1:
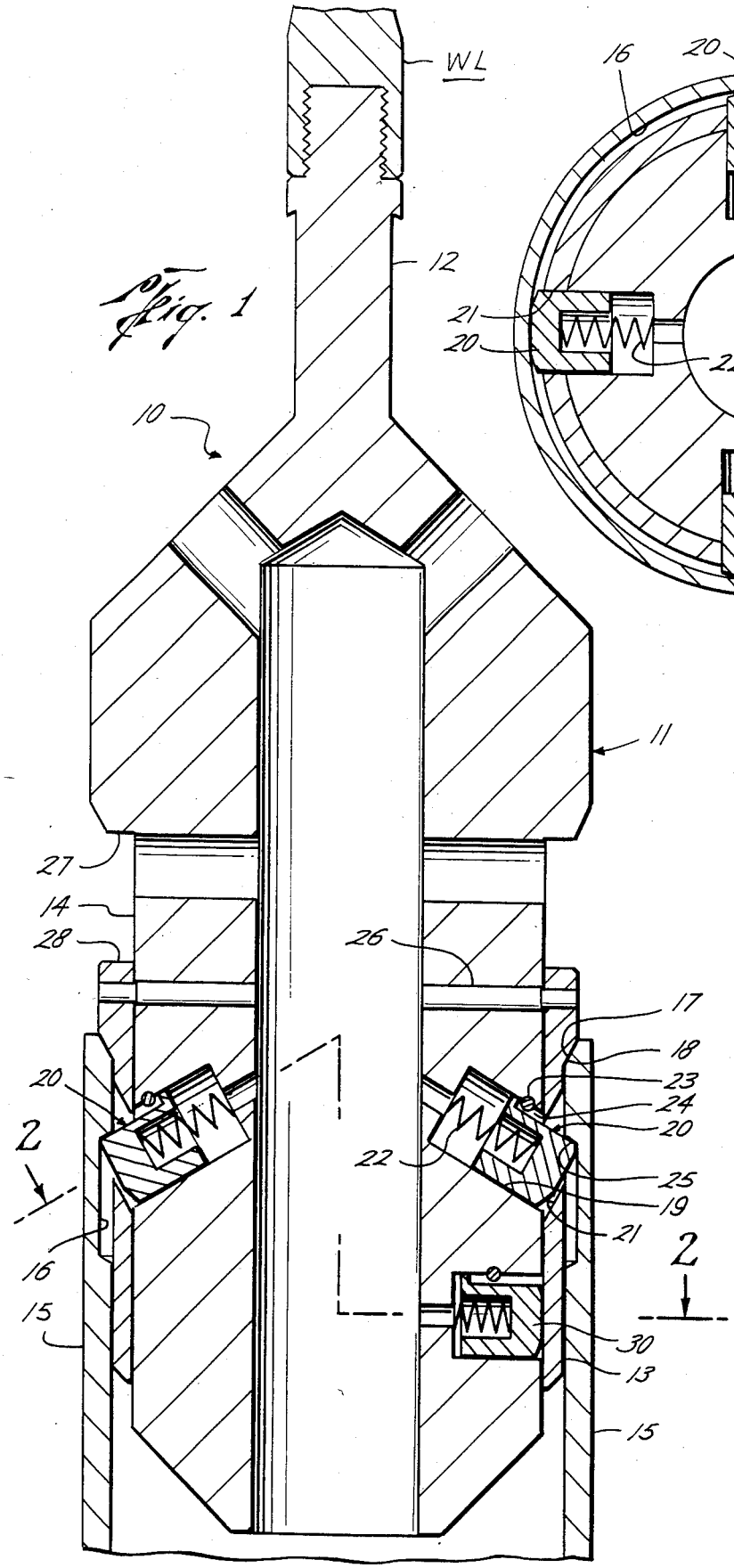
FIG. 1 is a vertical sectional view of a wire line tool constructed in accordance with one embodiment of the present invention in which the latches are mounted on the body of the tool for sliding downwardly and outwardly into an internal groove in the upper end of a well tool.
Figure 2:
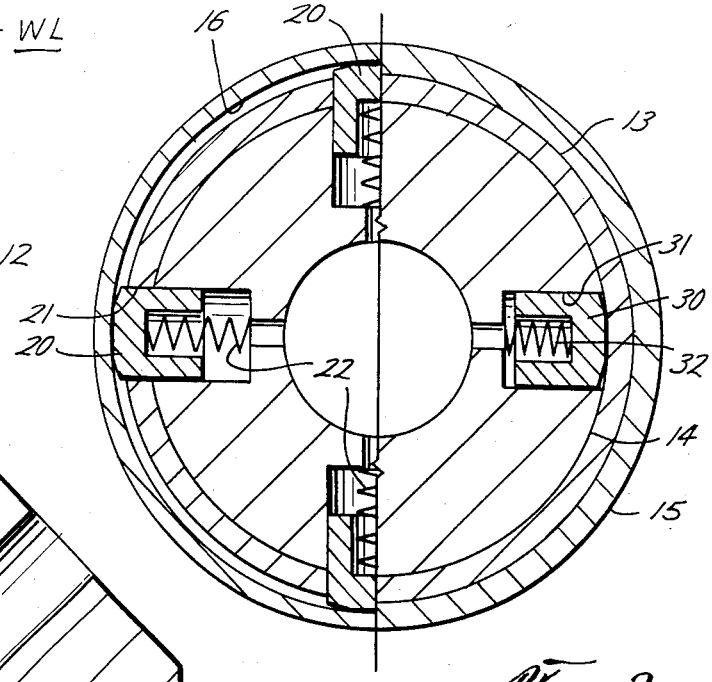
FIG. 2 is a cross-sectional view of the wire line tool and well tool of FIG. 1, as seen along broken lines 2—2 of FIG. 1.
Figure 3:
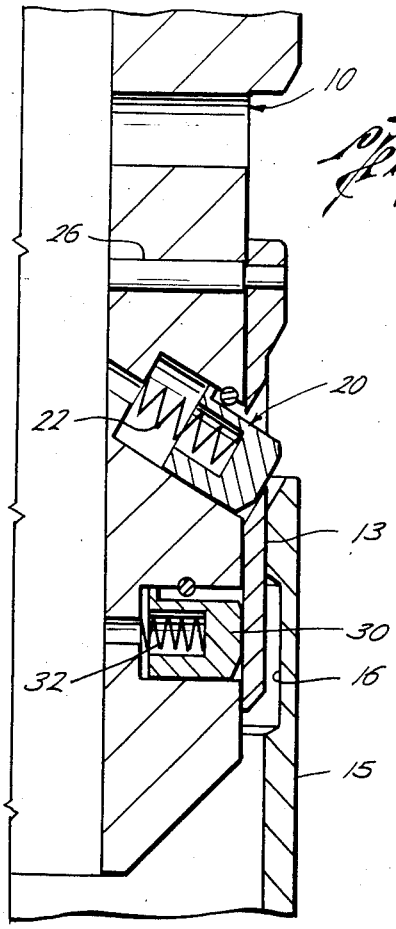
FIG. 3 is a partial vertical sectional view of the lower end of the wire line tool of FIG. 1 during initial movement thereof into the upper end of the well tool.
Figure 4:
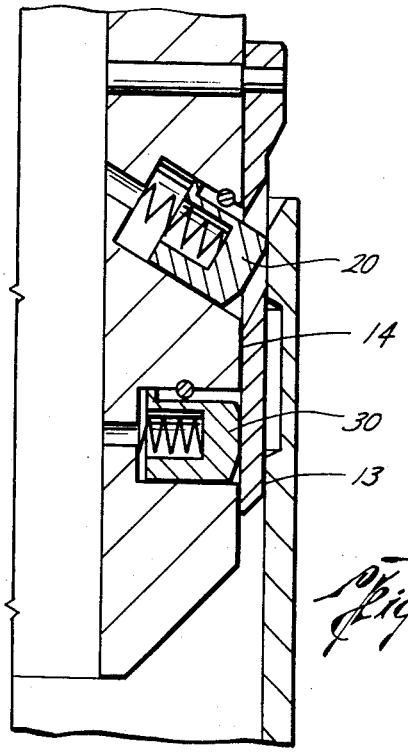
FIG. 4 is a view similar to FIG. 3, but upon further movement of the wire line tool into the well tool to force the outer ends of the latches inwardly as they move toward the groove in the well tool.

The slots 19 are of such depth as to permit the latches to slide between the outer latched position of FIGS. 1, 2, and 3, in which their outer ends extend beyond the outer end of the diameter of the sleeve for latching with the groove 16, the intermediate position of FIG. 4 in which the outer ends of the latches are partially retracted to permit them to move within the well tool during assembly or disassembly of the tool, and the inner position shown in FIG. 5 in which their outer ends are within the inner diameter of sleeve 13 to permit the retrieval of the tool. More particularly, the latches are yieldably urged toward their outer positions by means of coil springs 22 compressed between the inner ends of the latches and the outer ends of the slots. The latches are retained within the slots during assembly and disassembly of the tool by means of pins 23 extending laterally through holes (not shown) in the body and within flats 24 formed in the upper sides of the latches.

The seat 17 at the upper end of the well tool as well as the outer ends of the latches 20 are tapered downwardly and inwardly with respect to the axis of the body, so that, during assembly of the wire line tool into latched position within the well tool prior to running same, or upon lowering of the wire line tool into connection with the well tool for the purpose of pulling the well tool, the latches will be cammed inwardly by the seat 17 as they move downwardly from the position shown in FIG. 3. When cammed inwardly in this manner, the outer ends of the latches will, upon continued lowering of the body, move downwardly along the inner diameter of the well tool above the groove 16, as shown in FIG. 4. Thus, the shoulder 18 and the upper bearing surfaces need be spaced apart a distance no greater than that required in order to insure movement of the latches into latching position following seating of shoulder 18 of the sleeve on the seat 17 of the well tool, so that, as previously described, just prior to landing of the shoulder 18 on the seat 17, the outer ends of the latches will move outwardly through the windows in the sleeve and into the groove adjacent its upper end.

As previously described, when assembled in latching position with the wire line tool at the wellhead, the well tool may be lowered therewith by means of the wire line into a desired position within the well bore, following which the wire line tool may be released therefrom and retrieved from the well bore. Alternatively, in the event the well tool 15 is located within the well bore, the wire line tool 10 may be lowered on the wire line 13 and caused to latch thereto as its lower end is lowered into the wire line tool, and then raised by the wire line 13 for pulling the wire line tool from the well bore.

As shown, guide surfaces on the upper and lower sides of the slot, and thus the bearing surfaces on the upper and lower sides of the latches, are parallel to one another as well as to the upper end 25 of the groove 16, so that, with the running tool latched to the well tool, the outer ends of the latches are prevented from moving inwardly as the well tool is lowered with the wire line tool into a desired position within a well bore, or alternatively as the well tool is raised with the wire line tool for retrieval from the well bore. Thus, the inward component of force acting on the latches due to the support of the upper end of groove 16 on the bearing surfaces on the upper sides of the latches is opposed by an opposite and equal outward component of force due to the support of the bearing surfaces on the lower sides of the latches on the guide surfaces of the lower sides of the slots. Thus, inward movement of the latches is prevented not only by the springs but also frictional resistance due to engagement between the bearing surfaces on the latches and slot and the upper end of the groove 16.

The sleeve is releasably mounted on the body 11 of the wire line tool by means of shear pins 26 to locate a downwardly facing shoulder 27 on the body at the upper end of the reduced diameter portion 14 thereof above an upwardly facing shoulder 28 on the upper end of the sleeve. In order to release the wire line tool from the well tool following running of the well tool into the well bore, and thus permit its retrieval from the well bore, a downward jar is imparted to the body through the wire line 13 in order to shear the pins 26 and thus permit the body 11 to be lowered with the wire line with respect to the sleeve. As the body is so lowered, the outer ends of the latches are cammed inwardly by cam surfaces on the lower ends 29 of the windows 21 of the sleeve and then slide within the inner diameter of the sleeve, so that, upon landing of the shoulder 27 upon shoulder 28, the outer ends of the latches are retained in their inner positions. To facilitate inward camming of the latches out of latching position, the outer ends of the latches as well as the lower edges 29 of the windows are tapered downwardly and inwardly with respect to the axis of the body.

One or more pins 30 are slidable inwardly and outwardly within a slot 31 formed within the body beneath the latches for movement between an inner position within the sleeve, prior to release and lowering of the body, as shown in FIGS. 1, 3 and 4, and an outer position in which the upper side of the pin is beneath the lower end of the sleeve, following lowering of the body, as shown in FIG. 5. More particularly, each such pin 30 is yieldably urged to its outer position by means of a spring 32 disposed between its inner end and the outer end of the slot 31, and the pin is so located that the upper side of the pin 30 will move below the lower end of the sleeve before shoulder 18 lands on seat 17. Thus, upon lifting of the body with the wire line, the pin will engage the sleeve 13 while the inner ends of the latches are still retained within the inner diameter of the sleeve.

In order to unlatch the wire line tool from the well tool, following pulling of the well tool it is first necessary to remove the shear pin 26, as shown in FIG. 1, so as to permit the body to be lowered into the sleeve thereof and the well tool. As previously described in connection with the retrieval of the wire line tool upon downward jarring to shear the pin 26, as the body is moved into the lower position shown in FIG. 5, the latches 20 will be retained within the sleeve 13 so as to permit the wire line tool to be lifted from within the well tool. Then, of course, in order to relatch the wire line tool to a well tool, the pin 30 is depressed to permit the sleeve to be moved to its lower position with respect to the body. As the sleeve is so moved, the latches 20 are urged outwardly through the windows in the sleeve, thus into their outer latching position. Then, upon alignment of holes provided in the body and the sleeve, another shear pin may be inserted therein so as to reconnect the sleeve to the body of the wire line tool.

As shown in FIGS. 6 to 8, the embodiment of the wire line tool which is indicated in its entirety by reference character 10A is similar in many respects to the tool 10. Hence, many of the parts of the tool 10A which correspond to those of the tool 10 are provided with reference characters which differ from those applied to corresponding parts of the tool 10 only by the suffix A. Thus, the tool 10A includes a body 11A adapted to be connected to a wire line, and a sleeve 13A which surrounds a reduced lower diameter portion 14A of the body 11A for relative vertical movement with respect to it. More particularly, the sleeve is mounted on the body of the wire line tool by shear pins, as will be described in detail to follow, so as to dispose windows 21A in the sleeve opposite latches 20A guidably slidable within slots 19A in the portion 14A of the body of the wire line tool. More particularly, the sleeve is so mounted as to dispose a shoulder 18A thereabout in position for engaging a shoulder of the well tool, such as that shown at 17 in FIG. 1, when the windows and latches are opposite the groove in the well tool, as indicated at 16 in FIG. 1. Also, the latches are yieldably urged to their outer latching positions by means of springs 22A, all in a manner described in connection with the tool 10.

As was also true of the running tool 10, latches 20A of tool 10A have flats 24A on their upper sides, and the outer ends of the flats provide bearing surfaces adapted to be disposed closely adjacent the upper end of the groove of the well bore, when the wire line tool is latched within the well tool. As described in connection with the prior embodiment, these bearing surfaces are so arranged with respect to the bearing surfaces on the lower sides of the latches engageable with the lower sides of the slots 19A as to prevent movement of the latches out of latching position as the well tool is raised and lowered by means of the wire line tool. The latches are retained within the slots by means of lateral pins 23A.

In order to release the wire line tool from the well tool upon running of the well tool, the body of the wire line tool is jarred downwardly to shear pins 34 connecting the sleeve to the body, and thus permit the body 11A to be lowered with respect to the sleeve and thus with respect to the well tool. As described in connection with running tool 10, the lower edges of the windows 21A will cam the latches inwardly and the outer ends of the latches will then slide downwardly within the sleeve as the body moves downwardly to land a shoulder 27A thereabout upon a shoulder 28A on the upper end of the sleeve. At this time, of course, the pin 30A radially slidable within slot 31A in the body of the running tool is urged outwardly by the spring 32A into a position in which it is beneath the lower edge of the sleeve 13A, whereby the upward movement of the body with respect to the sleeve is limited so that the latches remain retained.

In accordance with this embodiment of the invention, the shear pins 34 extend through the sleeve and tangentially within an annular groove 35 about the body so as to permit the sleeve and body to be rotated relative to one another without shearing the pins. The sleeve and body are held in relative rotative positions in which the latches 20A extend through the windows 21A by detent means which includes a slot 36 formed in the outer side of the enlarged diameter portion of the body 11A, a slot 37 formed in the inner diameter of the upper end of the sleeve 13A, and leaf springs 38 which are mounted on the body by means of screws 39 and whose free ends extend upwardly into the aligned slots 36 and 37 in the sleeve and body, respectively. Upon depression of the free ends of the leaf springs 38, they are removed from the slots 37 so as to permit the sleeve to be rotated with respect to the body.

As shown in FIG. 6, a cam surface 40 is formed on the sleeve to one side of each window 21A so as to rotate into engagement with the outer end of the latch extending through the window and thereby force the latch inwardly, and then, as the cam moves over the outer end of the latch, cause the inner diameter of the sleeve to the right side of the cam to slide over the outer ends of the latches in order to retain them in their inner positions. More particularly, and as will be apparent from the drawings, the lower end of the cam surface will initially engage and slide over the outer, non-cylindrical end of each latch so as to exert an inwardly directed force thereon which retracts the latches as the cam continues to slide over its outer end.

As previously mentioned, this unique arrangement enables the wire line tool to be unlatched from the well tool, upon pulling of the well tool, and then relatched to a well tool, not only without manually compressing a large spring but also without shearing or removing one or more shear pins. Thus, instead, it is merely necessary that the operator depress the free ends of the leaf springs 38 so as to permit the body 11A to be rotated through an angle sufficient to cam the latches 20A inwardly and then retain them within the inner diameter of the sleeve, following which the lower portion of the wire line tool need merely be lifted from the well tool. When the wire line tool is to be relatched to a well tool, its lower end need merely be lowered into the well tool, and the body 11A again rotated until such time that leaf spring 38 springs outwardly into slot 37. As the body is moved into this rotative position, the latches 20A will have moved into positions opposite the windows 21A, so that their outer ends will be yieldably urged through the windows and into the latching position of FIG. 7.

The embodiment of the wire line tool shown in FIGS. 9 to 14, and indicated in its entirety by reference character 10B, is also similar in many respects to the tool 10 and thus the tool 10A. Hence, many of its parts which correspond to those of the previously described tools bear the same reference characters except for the addition of the suffix B. Thus, tool 10B includes a body 11B which has a neck 12B adapted to be connected to a wire line WL, and a sleeve 13B which surrounds a reduced lower diameter portion of the body for relative vertical movement with respect to it between the lower position of the sleeve shown in FIG. 9 and the upper position thereof shown in FIG. 12. In this latter position, a shoulder on the lower end of the enlarged diameter portion of the body engages with the upper end of the sleeve 13B.

In this embodiment of the invention, body 11B is made up of an inner body portion 11B' having the neck 12B at its upper end for connection with the wire line WL, and an outer portion 11B" which surrounds the inner portion 11B' beneath the neck 12B. As shown, an inner shoulder of the outer body portion 11B" is supported on an outer shoulder of the inner body portion 11B", and the body portions are releasably connected against rotation relative to one another by a detent mechanism which will be described in detail to follow.

The sleeve 13B is connected by shear pins 40 to the lower end of the outer body portion 11B" to mount it in its lower position, and the sleeve and inner body portion are held against relative rotation by means of pin 39 slidable in vertical slot 39'. Thus, lugs on the lower ends of latching dogs 20B which are carried with an annular slot 19B about the inner body portion 11B' are positioned within windows 21B formed in the sleeve. The sleeve has a downwardly facing shoulder 18B thereabout which is adapted to engage a seat or upwardly facing shoulder 17B on the upper end of a well tool 15B, as the lower end of the sleeve is lowered into the open upper end of the well tool, so as to dispose the windows 21B and thus lugs on the dogs 20B opposite an annular groove 16B about the inner diameter of the well tool.

The latching dogs are urged downwardly along the inner body portion by means of a compression coil spring 22B acting between the lower end of the outer body portion 11B" and the upper ends of the latching dogs. Thus, with the sleeve landed on the upper end of the well tool to dispose of windows 21B opposite the groove 16B, the springs 22B urge the lugs of the lower ends of the dogs downwardly and outwardly through the windows 21B and beyond the sleeve 13B into groove 16B, whereby the well tool is latched to the wire line tool. Thus, as shown, the lower end of the slot 19B has downwardly and outwardly tapered conical surfaces over which the lower tapered ends of the dogs are slidable to force them into their outer positions under the urging of spring 22B. When the lower ends of the lugs are seated on the outermost conical surface, they are held in their outer positions by means of a cylindrical surface intermediate the upper and lower conical surfaces on the body.

As the lower end of the wire line tool is moved into the open upper end of the well tool, the lowered tapered ends of the lugs which project through windows 21B will engage the upper end of the well tool, and thus be moved upwardly to compress the spring 22B, and thereby permit them to be raised above the cylindrical surface of the slot and cammed outwardly to permit the lugs to be moved through the open upper end of the well tool and into a position in which windows 21B are opposite the groove 16B. At this time, as previously described, the spring 22B expands to move the latching dogs downwardly and outwardly into the latching position of FIG. 9.

On the other hand, when the body is moved downwardly with respect to the sleeve, the dogs 20B are lowered against the cam surface at the lower edge of each window 21B which is tapered downwardly and inwardly so as to urge the locking dogs upwardly and inwardly against the force of the spring 22B. More particularly, when the sleeve is in its upper position with respect to the body, as shown in FIG. 12, the cam surfaces on the lower side of the windows 21B hold the lugs of the latching dogs in their inner positions to which they have been cammed during lowering of the wire line tool into the well tool. With lugs thus held inwardly, and the sleeve supported in its upper position from the body, as will be described, the running tool 10B may be retrieved from the well tool, by raising of the wire line tool with respect to the well tool, as shown in FIG. 12. As in the case of the previously described embodiment, a plurality of pins 30B are mounted within holes 31B in the lower end of the body for radial movement with respect thereto, and are urged to their outer positions by means of compression springs 32B so that when the sleeve has been moved upwardly with respect to the body, as shown in FIG. 12, the pins are automatically moved outwardly to a position beneath the lower ends of the sleeve, so as to support the sleeve in a position in which is holds the latches inwardly.

As best shown in FIGS. 11 and 14, shear pins 40 extend through holes 41 in the sleeve 13B and tangentially within arcuate grooves 42 formed in opposite sides of the outer body portion 11B'' near its lower end. More particularly, the sides 43 of the lower end of the outer body portion intermediate the arcuate grooves 42 are flat and tangential to the inner diameter of the grooves 42 and extend upwardly therefrom to the shoulder on the lower end of the enlarged diameter portion of outer body portion 11B''. Thus, upon rotation of the outer body portion approximately 90°, as shown by comparison of FIGS. 11 and 14, the flats 43 are moved into vertical alignment with the shear pins 40 so that the sleeve is free to move to its upper position with respect to the body, as shown in FIG. 12.

As the sleeve is moved in this manner, the cam surfaces on the windows 21B engage the lugs on the lower ends of the dogs 20B to lift them above the cylindrical holding surface of the slot 19B and along the upper connical surface of the slot, and thus, upon continued upward movement of the sleeve, inwardly out of the groove 16B, and then held in their inner positions, as shown in FIG. 12. This then enables the wire line tool to be removed from the well tool without the necessity of manually manipulating a strong spring, or shearing or removing the pins 40. More particularly, and as previously described, raising of the sleeve 13B to its upper position also permits the pins 30B to be moved outwardly to positions beneath the lower end of the sleeve to hold the sleeve in its upper latch retaining position.

The detent means for releasably holding the body portions against rotation with respect to one another, and thus preventing the outer body portion 11B'' from being rotated from the position of FIGS. 9 to 11 to the position of FIGS. 12 to 14, comprises a pin 45 which extends through a hole 46 in the inner body portion 11B', and which has a locking part 46 on its lower side near one end which is adapted to be spring pressed into a radially extending slot 47 formed in the upper surface of a lower section of the outer body portion. As shown in FIGS. 9 and 12, a coil spring 48 is compressed the opposite end of the pin 45 and the outer end of a recess 49 formed in the bottom surface of the lower section of the outer body portion opposite the slot 47. Thus, in order to release the locking part 46 from the slot 47, the pin 45 is pushed inwardly against the force of the spring 48 so as to move the locking part 46 radially inwardly from the slot 47 and within the inner diameter of the outer body portion which surrounds the inner body portion.

As best shown in FIGS. 10 and 13, an arcuate groove 50 is formed in the upper surface of the lower section of the outer body portion 11B'' to surround its inner diameter for approximately 90° between an end surface aligned with one end of pin 45, and an abutment 51 at its upper end. Thus, upon depression of the pin 45 inwardly, its left hand end moves into groove 50 to permit the outer body to be rotated in a clockwise direction, and its lock part 46 to slide over the inner diameter of the outer body portion until abutment shoulder 51 engages the lower side of the lefthand end of the pin, as shown in FIG. 13. As previously described, the shear pins 40 are thus vertically aligned with the straight sides 43 of the outer body portion so that the sleeve 13B is free to be moved upwardly to its upper position in order to cam the latching dogs inwardly and hold them in their inner positions.

When it is desired to return the wire line tool to a position for latching to a well tool, it merely necessary to depress pins 30B to permit the sleeve to be lowered to its position of FIG. 9, and then rotate the outer body portion in a clockwise direction with respect to the inner body portion to move pins 40 back into arcuate grooves 42. As slot 47 moves into alignment with the locking part 46, the spring 48 forces the pin 45 to the right and thus moves the locking part 46 into the slot so as to reengage the detent means to releasably hold the body portions against relative rotation.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A wire line tool for running and/or pulling a well tool having a seat thereon and an annular groove about its inner diameter, comprising a body adapted to be raised and lowered on a wire line, latches carried by the body for sliding along guide surfaces on the body which extend downwardly and outwardly with respect to the axis of the body, means on the body cooperable with the seat of the well tool for locating the outer ends of the latches opposite the groove when the body is disposed within the well tool, and means yieldably urging the latches from inner positions in which their outer ends are adapted to move through the well tool into and out of positions opposite the groove, to outer positions in which their outer ends extend into the groove when opposite thereto, the upper sides of the latches having bearing surfaces which are engageable with the upper end of the groove, when the outer ends of the latches extend into the groove, to support the well tool from the wire line tool, and which are so related to bearing surfaces on the lower sides of the latches which are engageable with the guide surfaces on the body, when the well tool is so supported, as to prevent inward movement of the latches, and means responsive to vertical movement of the body with respect to the well tool for moving said latches inwardly to retract their outer ends from the groove and retain them in retracted positions, so that the wire line tool may be retrieved from the well tool.

2. A tool of the character defined in claim 1, wherein the bearing surfaces on the upper and lower sides of the latches and the upper end of the groove are essentially parallel.

3. A wire line tool for running and/or pulling a well tool having a seat thereon and an annular groove about its inner diameter, comprising a body adapted to be raised and lowered on a wire line, latches carried by the body for sliding along guide surfaces on the body which extend downwardly and outwardly with respect to the axis of the body, a sleeve about the body having cam surfaces thereon, means mounting the sleeve on the body to dispose the cam surfaces adjacent the outer ends of the latches, means on the sleeve cooperable with the seat of the well tool for locating the outer ends of the latches opposite the groove, means yieldably urging the latches from inner positions, in which their outer ends are adapted to move through the well tool into and out of positions opposite the groove, to outer positions in which their outer ends extend beyond the sleeve and into the groove when opposite thereto, the upper sides of the latches having bearing surfaces which are engageable with the upper end of the groove, when the outer ends of the latches extend into the groove, to support the well tool from the wire line tool, and which are so related to bearing surfaces on the latches which are engageable with the guide surfaces on the body, when the well tool is so supported, as to prevent inward movement of the latches, said mounting means being releasable to permit the body to be moved vertically in one direction with respect to the sleeve, and the outer ends of the latches being cammed inwardly and out of the groove by the cam surfaces and held inwardly as the body is so moved, and means for limiting movement of the body in the opposite vertical direction so that the latches are retained, by the sleeve to permit the wire line tool to be retrieve from the well tool.

4. A tool of the character defined in claim 3, wherein the body is movable downwardly upon release of the mounting means and has means thereon providing a downwardly facing shoulder, and the sleeve has an upwardly facing seat spaced beneath the body shoulder and engageable thereby when the body has been lowered to force the outer ends of the latches out of the groove.

5. A tool of the character defined in claim 3, wherein said means for limiting movement of the body comprises at least one pin carried by the body for inward and outward movement with respect thereto, and means for yieldably urging the pin to a position to engage a shoulder on the sleeve upon movement of the body to force the latches inwardly out of the groove.

6. A tool of the character defined in claim 4, wherein said means for limiting movement of the body comprises at least one pin carried by the body for inward and outward movement with respect thereto, and means for yieldably urging the pin to a position to engage a downwardly facing shoulder on the sleeve upon movement of the body to force the latches inwardly out of the groove.

7. A wire line tool for running and/or pulling a well tool having a seat thereon and an annular groove about its inner diameter, comprising a body adapted to be raised and lowered on a wire line, latches carried by the body for expansion and contraction with respect thereto, a sleeve having cam surfaces thereon, means connecting the sleeve to the body to limit relative axial movement while permitting relative rotation between them, said sleeve having means cooperable with the seat in the well tool, upon movement of the body into the well conduit, for locating the outer ends of the latches opposite the groove, detent means for locating the cam surfaces of the sleeve in substantial vertical alignment with the outer ends of the latches, and means yieldably urging the latches from inner positions in which their outer ends may be retained within the sleeve to outer positions in which their outer ends extend into the groove when opposite thereto, said connecting means being shearable to permit the body to be moved vertically in one direction with respect to the sleeve to cause the cam surfaces thereon to retract the latches and retain them in their inner positions, means automatically responsive to movement of the body in said one direction to limit its movement in the opposite vertical direction and thereby permit the wire line tool to be retrieved from the well tool said sleeve having additional cam surfaces thereon to one side of the outer end of each latch which is operable, upon release of the detent means and rotation of the sleeve, for retracting the latches and retaining them in their inner positions, whereby the wire line tool may be removed from the well tool without releasing the connecting means.

8. A tool of the character defined in claim 7, wherein the body has an arcuate groove thereabout, and the connecting means comprises at least one shear pin extending through the sleeve and tangentially within a portion of the groove.

9. A tool of the character defined in claim 7, wherein the detent means comprises a slot in the outer side of the body, a slot in the inner side of the sleeve axially aligned with the slot in the body when the windows are opposite the latches, and leaf springs mounted on the body and extending into the slots, the free ends of the springs in the body slots being depressible to remove the springs from the slots in the sleeve.

10. A wire line tool for running and/or pulling a well tool having a seat thereon and an annular groove about its inner diameter, comprising a body adapted to be raised and lowered on a wire line, latches carried by the body for inward and outward movement with respect thereto, a sleeve disposed about the body for shifting between upper and lower positions with respect thereto, said sleeve having windows therein disposable opposite the latches in its lower position and a shoulder thereon engageable with the seat to locate the openings opposite the groove, means yieldably urging the latches toward their outer positions and thus through the windows, and beyond the sleeve into the groove, when the sleeve is its lower portion, said body having a groove formed in the outer diameter of a portion thereof, a pin extending through the sleeve and within the groove to hold the sleeve in its lower position, said pin being shearable in response to a downward jar on the body, and the sleeve having cam means thereon for forcing the latches inwardly and out of the groove, as the sleeve is moved to its upper position, means automatically responsive to movement of the sleeve to its upper position to prevent its return to its lower position, said groove being arcuate to permit relative rotation between said sleeve and body portion, cam means on the sleeve which is operable, upon such rotation, for forcing said latches inwardly and holding them in their inner positions without shearing the pin, and detent means for releasably holding the sleeve and body portion against rotation.

11. As in claim 10, wherein the latches are carried by said body portion, said last-mentioned cam means is in addition to the first mentioned cam means and arranged to force said latches to their inner positions in response to rotation of said sleeve and body portion with respect to one another, and said detent means is releasably engageable between said body portion and sleeve.

12. As in 10, wherein the latches are carried by another portion of the body which is rotatable with respect to the first mentioned portion, the sleeve is held against rotation with respect to such other portion, the first mentioned body portion has means into which the pin may move, upon rotation of the sleeve and first mentioned body with respect to one another, to permit the sleeve to be moved to its upper position so that the latches are forced inwardly by the same cam means which forces them inwardly upon shearing the pin, and said detent means is releasably engageable between said first mentioned body portion and sleeve.

* * * * *